US009352551B2

(12) United States Patent
Peleg et al.

(10) Patent No.: US 9,352,551 B2
(45) Date of Patent: May 31, 2016

(54) MEDIA PRESSURE ROLLER FOR A PRESS

(75) Inventors: Eyal Peleg, Nes Ziona (IL); Sharon Nagler, Nes Ziona (IL); Lior Fishbain, Nes Ziona (IL); Alex Feygelman, Nes Ziona (IL); Amit Porat, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 96 days.

(21) Appl. No.: 14/002,575

(22) PCT Filed: Mar. 11, 2011

(86) PCT No.: PCT/US2011/028030

§ 371 (c)(1),
(2), (4) Date: Aug. 30, 2013

(87) PCT Pub. No.: WO2012/125136

PCT Pub. Date: Sep. 20, 2012

(65) Prior Publication Data

US 2013/0333580 A1 Dec. 19, 2013

(51) Int. Cl.

| | |
|---|---|
| ***B41L 35/14*** | (2006.01) |
| ***B41F 27/00*** | (2006.01) |
| ***B41F 23/00*** | (2006.01) |
| ***G03G 15/16*** | (2006.01) |
| ***B41F 25/00*** | (2006.01) |

(52) U.S. Cl.

CPC ..... *B41F 27/005* (2013.01); *B41F 23/00* (2013.01); *B41F 23/007* (2013.01); *B41F 25/00* (2013.01); *G03G 15/1605* (2013.01); *G03G 15/1695* (2013.01); *B41P 2227/70* (2013.01)

(58) Field of Classification Search

CPC ..... B41F 23/007; B41F 25/00

USPC ..... 101/488

See application file for complete search history.

(56) References Cited

U.S. PATENT DOCUMENTS

| | | | | | |
|---|---|---|---|---|---|
| 3,718,059 | A | * | 2/1973 | Clayton | B26F 1/24 264/154 |
| 4,253,396 | A | | 3/1981 | Wieland | |
| 4,414,896 | A | * | 11/1983 | Fischer | 101/211 |
| 4,893,555 | A | * | 1/1990 | Leyland et al. | 101/29 |
| 4,973,384 | A | * | 11/1990 | Crouse et al. | 162/358.5 |
| 5,279,697 | A | * | 1/1994 | Peterson et al. | 156/358 |
| 5,398,925 | A | * | 3/1995 | Zeltner | B41F 25/00 101/142 |
| 5,412,459 | A | | 5/1995 | Borsuk et al. | |
| 5,598,779 | A | * | 2/1997 | Haas | B41F 21/108 101/183 |
| 6,194,109 | B1 | | 2/2001 | Lawton | |
| 6,302,021 | B1 | | 10/2001 | Wadlinger | |
| 6,466,764 | B2 | | 10/2002 | Jacob et al. | |
| 6,563,524 | B1 | | 5/2003 | Regimbal et al. | |

(Continued)

FOREIGN PATENT DOCUMENTS

WO 9712287 4/1997

OTHER PUBLICATIONS

CN Office Action, May 12, 2014, 10 pages.

*Primary Examiner* — Anthony Nguyen

(57) ABSTRACT

A press includes a blanket cylinder, an impression cylinder, and a roller. The impression cylinder rollingly engages the blanket cylinder to form a nip and includes at least one gripper configured to selectively secure an end of a media sheet relative to the impression cylinder. The roller is selectively engageable against the impression cylinder to apply to pressure to the secured media sheet prior to its passage through the nip.

13 Claims, 5 Drawing Sheets

(56) References Cited

U.S. PATENT DOCUMENTS

| | | | | |
|---|---|---|---|---|
| 6,619,201 | B1 * | 9/2003 | Becker et al. | 101/230 |
| 6,622,623 | B1 | 9/2003 | Helmstadther et al. | |
| 6,754,457 | B2 | 6/2004 | Ciaschi et al. | |
| 6,829,456 | B2 | 12/2004 | Regimbal et al. | |
| 6,851,361 | B2 * | 2/2005 | Gorbing | B41F 21/106 101/230 |
| 7,679,630 | B2 | 3/2010 | Sagi et al. | |
| 7,731,190 | B2 | 6/2010 | Taig et al. | |
| 7,734,244 | B2 | 6/2010 | Yu et al. | |
| 2003/0221571 | A1 * | 12/2003 | Jung | B41F 23/08 101/416.1 |
| 2009/0139420 | A1 | 6/2009 | Festa et al. | |
| 2010/0132569 | A1 * | 6/2010 | Yumoto | B29D 11/00278 101/216 |

* cited by examiner

MEDIA PRESSURE ROLLER FOR A PRESS

CROSS-REFERENCE TO RELATED APPLICATIONS

This Utility Patent Application is a U.S. National Stage filing under 35 U.S.C. §371 of PCT/US11/28030, filed Mar. 11, 2011 incorporated by reference herein.

BACKGROUND

In an offset press or in a portion of a digital offset press, an image is transferred to a media on a color-by-color basis in which each color for an image is applied separately. In this arrangement, a given media sheet will pass through an image-transfer nip multiple times before the entire image is formed onto the media sheet.

However, several factors can cause distortion of the media sheet as each color is successively applied to the media sheet. For instance, sometimes distortion can result from pressure and/or temperature that are used to facilitate transfer of the image onto the media sheet upon each pass of the media sheet through the image-transfer nip. Moreover, distortion also can result from variables associated with how the media sheet is fed into and settles in a gripper mechanism of the impression cylinder that carries the media sheet during printing. Unfortunately, because these factors can cause the media sheet to become distorted slightly from one color separation to the other, print quality can suffer because the registration between colors will vary from print to print.

One conventional approach used for an offset press to overcome color plane mis-registration due to these distortions relies on calibration and preventing stresses. Another conventional approach used for digital offset presses includes adding one idle cycle, which improves the initial paper settling on the impression cylinder, which in turn, improves color plane registration. On the other hand, adding an idle cycle is undesirable because it decreases press productivity.

For at least these reasons, conventional approaches still fall short of achieving consistent color plane registration without compromising press productivity.

DETAILED DESCRIPTION

Figure 1:
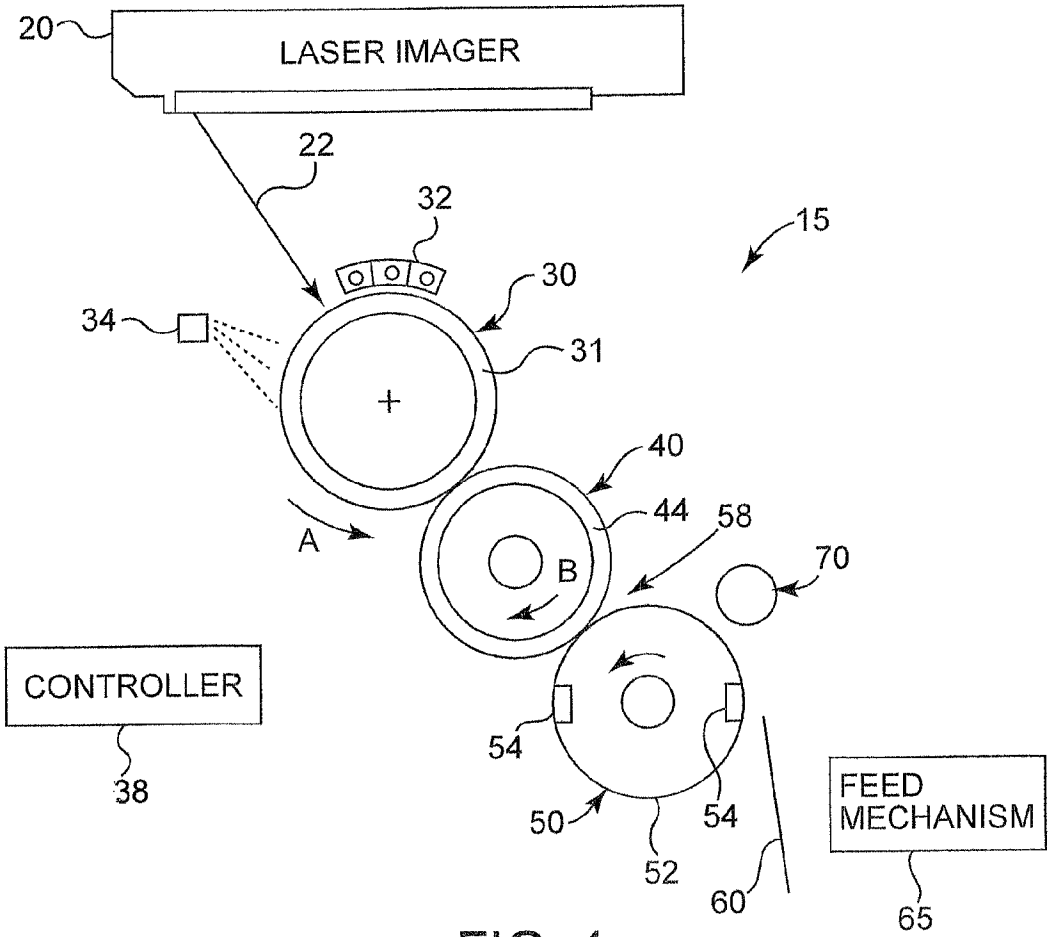
FIG. 1 is a side view schematically illustrating a press, according to an embodiment of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the present disclosure ensure proper color plane registration between a media sheet (carried by an impression cylinder) and an image (carried by a blanket cylinder—an intermediate cylinder covered with blanket) via a roller assembly that flattens the retained media sheet, prior to a nip between the blanket cylinder and the impression cylinder. In one embodiment, a press comprises a blanket cylinder, an impression cylinder, and a conditioning roller selectively engageable against the impression cylinder to apply to pressure to the secured media sheet passing between the conditioning roller and the impression cylinder. The impression cylinder rollingly engages the blanket cylinder to form an image-transfer nip. The impression cylinder includes at least one gripper configured to selectively secure an end of a media sheet relative to the impression cylinder. The conditioning roller is selectively engageable against the impression cylinder to apply to pressure to the secured media sheet prior to its passage through the image-transfer nip. In one aspect, the location at which this pressure is applied via the conditioning roller is an area that is free from ink.

In some embodiments, in addition to applying pressure to the media sheet, the conditioning roller also applies heat simultaneous with the applied pressure. The heat enhances ink adhesion when the image is transferred to the media sheet.

With this arrangement, prior to the media sheet entering the image-transfer nip, a conditioning roller flattens the media sheet to overcome any introduced deformations, and thereby achieve color plane registration throughout the different color separations without decreasing overall press productivity.

These embodiments, and additional embodiments, are described in association with FIGS. 1-8.

One embodiment of a press 15 is illustrated in FIG. 1. As shown in FIG. 1, press 15 comprises a laser imager 20, an imaging cylinder 30, a blanket cylinder 40 (which acts an intermediate transfer cylinder), and an impression cylinder 50. In addition, press 15 comprises a charging station 32, a developing station 34, and a controller 38. In one aspect, imaging cylinder 30 includes an outer electrophotographic surface or plate 31 while the blanket cylinder 40 includes a blanket 44. It will be understood, as familiar to those skilled in the art, that the terms roller, cylinder or drum are generally interchangeable in referring to these known elements of an electrophotographic printing system, such as a digital offset press like press 15.

While not shown in FIG. 1, in other embodiments press 15 additionally comprises excess ink collection mechanisms, cleaners, additional rollers, and the like as familiar to those skilled in the art. A brief description of the operation of press 15 follows.

In preparation to receive an image, imaging cylinder 30 receives a charge from charging station 32 (e.g., a charge roller or a scorotron) in order to produce a uniform charged surface on electrophotographic surface 31 of imaging roller 30. Next, as imaging roller 30 rotates (as represented by directional arrow A), laser imager 20 projects an image via beam 22 onto the surface 31 of imaging cylinder 30, which discharges portions of the imaging cylinder 30 corresponding to the image. These discharged portions are developed with ink via developing station 34 to "ink" the image. As imaging cylinder 30 continues to rotate, the image is transferred onto the electrically biased blanket 44 of the rotating blanket cylinder 40. Rotation of the blanket cylinder 40 (as represented by directional arrow B), in turn, transfers the ink image onto a media 60 that will pass through the pressure nip 58 between blanket cylinder 40 and impression cylinder 50.

Impression cylinder 50 is configured to releasably secure media 60 about surface 52 of impression cylinder 50 so that media 60 is wrapped around impression cylinder 50 as media 60 passes through the pressure nip 58. In one embodiment, impression cylinder 50 includes one or more grippers 54 configured to selectively hold an end of a media sheet to releasably secure the media sheet relative to surface 52 of impression cylinder 50. While grippers 54 are shown schematically for illustrative purposes, one skilled in the art will be familiar with a variety of gripper mechanisms, including those shown in Wieland U.S. Pat. No. 4,253,396, among many others.

Press 15 also includes a feed mechanism 65 configured to feed media sheets 60, one at a time, to impression cylinder 50. While not shown for illustrative clarity, it will be understood that feed mechanism 65 includes appropriate guides to direct transport of media sheets 60 so that a first end 61 of media sheet 60 becomes positioned to be retained via one of the grippers 54 on impression cylinder 50.

Press 15 also includes a conditioning roller 70 positioned for selective engagement directly against impression cylinder 50 to condition media sheet 60 prior to its passage through nip 58, as will be described in more detail throughout FIGS. 2-7.

FIGS. 2-7 are side views that schematically illustrating a series of states of a roller assembly 100 of press 15, according to an embodiment of the present disclosure, as a media sheet moves through the roller assembly.

Figure 2:
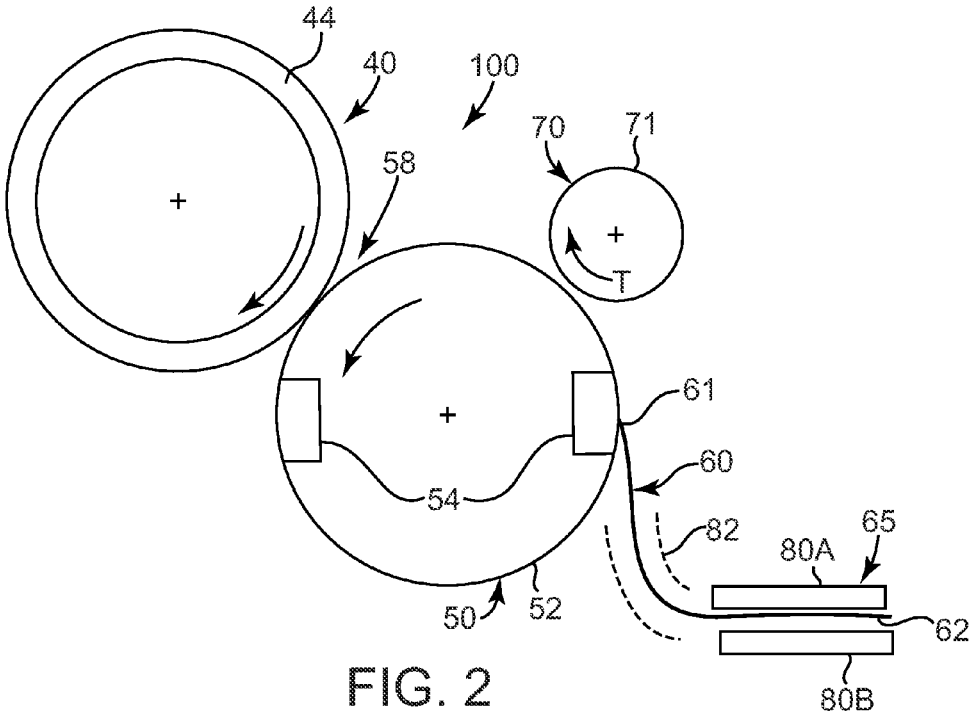
FIGS. 2-7 are side views that schematically illustrating a series of states of a roller assembly of a digital offset press, according to an embodiment of the present disclosure, as a media sheet moves through the roller assembly.

FIG. 2 schematically illustrates roller assembly 100 of press 15, which includes blanket cylinder 40, impression cylinder 50, conditioning roller 70, and feed mechanism 65. As shown in FIG. 2, in one embodiment feed mechanism 65 includes a pair of guides 80A, 80B for guiding media sheet 60 so that a first end 61 of sheet 60 becomes positioned adjacent one gripper 54 of impression cylinder 50. Through actions familiar to those skilled in the art, gripper 54 acts to releasably secure first end 61 of sheet 60. In some embodiments, feed mechanism 65 includes a guide pathway (represented in dashed lines 82) to direct media sheet 60 through a change in orientation or direction so that media sheet 60 becomes generally aligned with contour of impression cylinder 50. With the media sheet 60 releasably secured relative to impression cylinder 50, on-going rotation of impression cylinder 50 acts to move media sheet 60 toward nip 58 and blanket cylinder 40.

Figure 3:
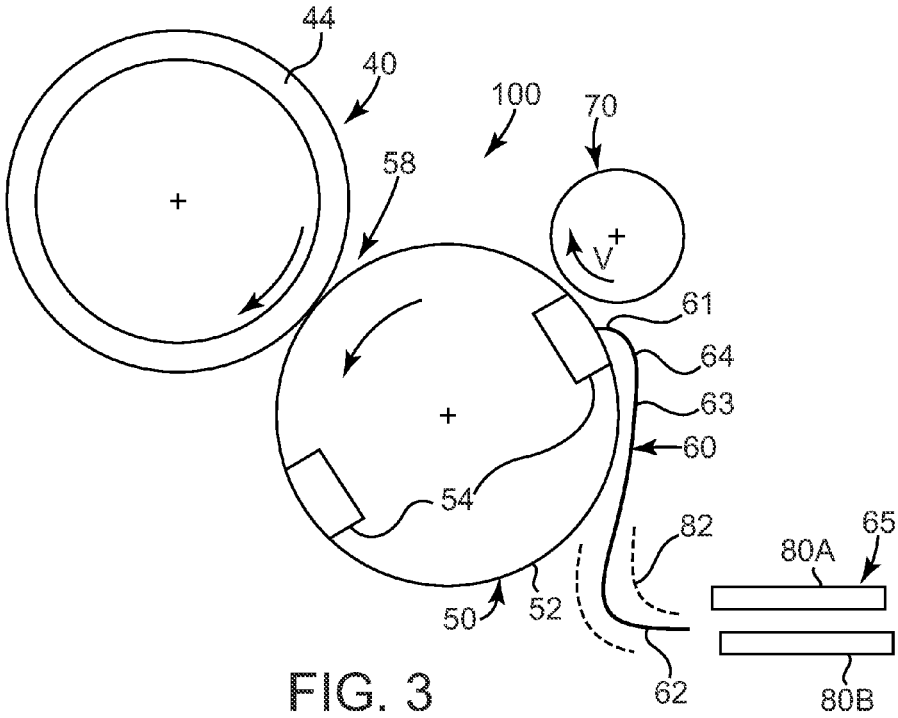

As shown in FIG. 3, once first end 61 of media sheet 60 has been releasably retained via one of the grippers 54 as impression cylinder 50 is rotating toward nip 58, a portion 64 of sheet 60 may protrude from surface 52 of impression cylinder 50. In one aspect, portion 64 represents a deformation of media sheet 60 that occurred during gripping of media sheet or from earlier processing of media sheet 60. As further shown in FIG. 3, via action of gravity and/or via the momentum of the rotating impression cylinder 50, body 63 of sheet 60 trails alongside surface 52 of impression cylinder 50. In some instances, such as when a media sheet is first fed onto impression cylinder 50, second end 62 of sheet 60 may remain partially in guide pathway 82 when the act of gripping takes place.

It will be understood that the degree to which portion 64 is raised from surface 52 as depicted in FIG. 3 may be exaggerated to some extent, for illustrative purposes. Nevertheless, without intervention, such raised portions 64 likely would result in color plane mis-registration as media sheet 60 would not be properly aligned with image carried on blanket 44 of blanket cylinder 40 (FIG. 1) upon sheet 60 entering nip 58. It will be further understood that the location, size, and/or orientation of raised portion 64 can be different each time that media sheet passes through image-transfer nip 58. In some instances, the orientation of raised portion 64 corresponds to a distortion that is primarily horizontal (across a width of the media sheet) while in other instances, the orientation of raised portion 64 corresponds to a distortion that is primarily vertical (along a length of the media sheet). In many instances, the orientation of the raised portion 64 corresponds to a distortion having both horizontal and vertical components.

Unlike conventional systems, embodiments of the present disclosure include a conditioning roller 70 which is positioned and arranged to engage media sheet 60 to ensure proper color plane registration relative to blanket 44 of blanket cylinder 40.

Figure 4:
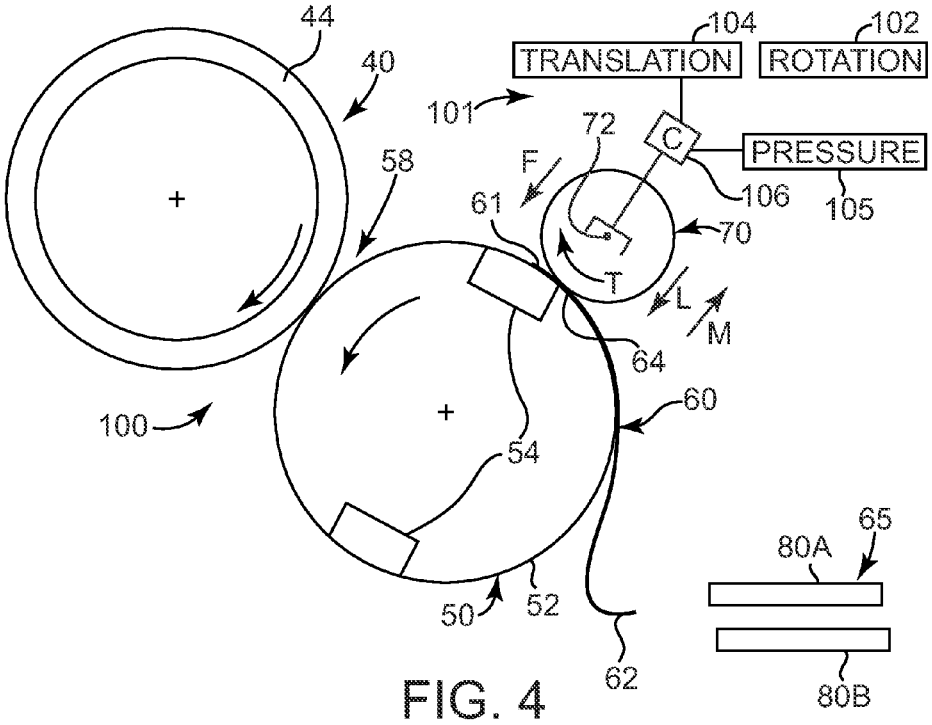

In particular, as impression cylinder 50 further rotates to move media sheet 60 toward nip 58, conditioning roller 70 is moved (from its spaced position) toward impression cylinder 50 until conditioning roller 70 directly contacts surface 52 of impression cylinder 50, as shown in FIG. 4. It will be understood that the moment of direct contact of conditioning roller 70 against impression cylinder 50 is timed so that conditioning roller 70 does not interfere with or other with contact any protruding portions of gripper 54 while still causing conditioning roller 70 to contact first end 61 of media sheet 60 as close as possible to gripper 54. In this way, beginning with the first end 61 of media sheet 60, conditioning roller 70 acts to flatten media sheet 60

As further shown in FIG. 4, in some embodiments, roller assembly 100 includes a control assembly 101 that is configured to control the interaction of conditioning roller 70 with impression cylinder 50. In one embodiment, control assembly 101 includes a rotation module 102, translation module 104, a pressure module 105, and a coupling mechanism 106. Coupling mechanism 106 facilitates engagement of the rotation module 102, translation module 104, and pressure module 105, respectively, relative to axis 72 of media-conditioning roller 70.

Rotation module 102 controls and implements a generally continuous rotation of conditioning roller 70 so that conditioning roller 70 is always ready to engage impression cylinder 50. In one aspect, rotation module 102 causes conditioning roller 70 to rotate such that, at the point of contact, conditioning roller 70 exhibits substantially the same velocity as impression cylinder 50 and in a direction (shown via arrow T) compatible with the rotation of impression cylinder 50.

Translation module 104 of control assembly 101 controls and implements a translational movement of roller 70 toward and away from impression cylinder 50. In one aspect, movement of roller 70 toward impression cylinder 50 (as represented by directional arrow L) causes engagement of roller 70 against impression cylinder 50 while movement of roller 70 away from impression cylinder 50 (as represented by directional arrow M) causes roller 70 to move to a rest position spaced apart from impression cylinder 50 (for example, see FIGS. 2, 7). Accordingly, with direction from controller 38, at the proper time the translation module 102 moves rotating roller 70 into contact with impression cylinder 50 to condition media sheet 60. After the entire sheet 60 has been conditioned, the translation module 104 moves the conditioning roller 70 out of contact with roller 50 to prevent contact of roller 70 with gripper 54. Upon successful passage over a gripper 54, translation module 104 causes conditioning roller 70 to re-engage impression cylinder 50.

Pressure module 105 of control assembly 101 controls and implements an application of pressure (as represented by directional force arrow F) by roller 70 against impression cylinder 50 while roller 70 rotates in contact against impression cylinder 50. As further described below, this applied pressure flattens media sheet 60 (against surface 71 of media-conditioning roller 70) as sheet 60 passes through nip 78 between impression cylinder 50 and media-conditioning roller 70.

The respective modules (rotation module 102, translation module 104, and pressure module 105) comprise software, firmware, and/or hardware, including a combination of components such as circuitry, actuators, guides, motors, etc. as known to those skilled in the art, to carry out the functions described above for conditioning roller 70. In addition, it will be understood that while control assembly 101 forms a part of roller assembly 100 depicted in FIGS. 2-7, the control assembly 101 is omitted from some Figures for illustrative clarity.

Figure 5:
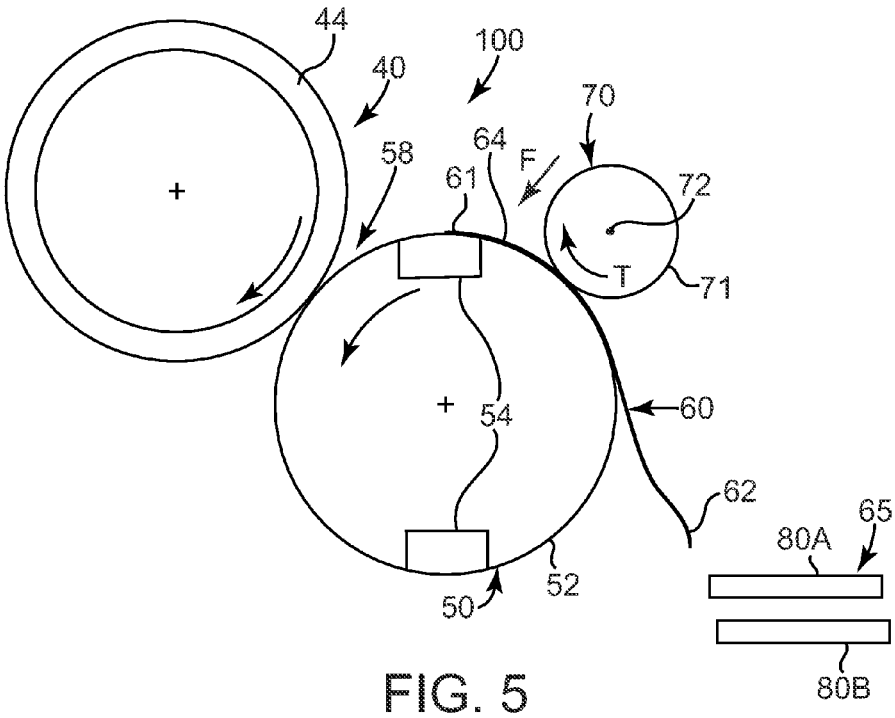

As shown in FIG. 5, as impression cylinder 50 continues rotating to move media sheet 60 toward nip 58 (between blanket cylinder 40 and impression cylinder 50), conditioning roller 70 continues to apply pressure via force (F) to flatten media sheet 60 on the surface 52 of impression cylinder 50.

Eventually, with the on-going rotation of impression cylinder 50 relative to the rotating blanket cylinder 40, media sheet 60 enters image-transfer nip 58. However, unlike conventional systems, media sheet 60 has been flattened, via pressure applied via roller 70, prior to entry into nip 58. This flattening action ensures that media sheet 60 will be generally free of any raised portions across its width or along its length, which in turn, ensures proper color plane registration of media sheet 60 with the image (carried on blanket cylinder 40) that is being transferred onto media sheet 60 and with images previously transferred onto media sheet 60.

Figure 6:
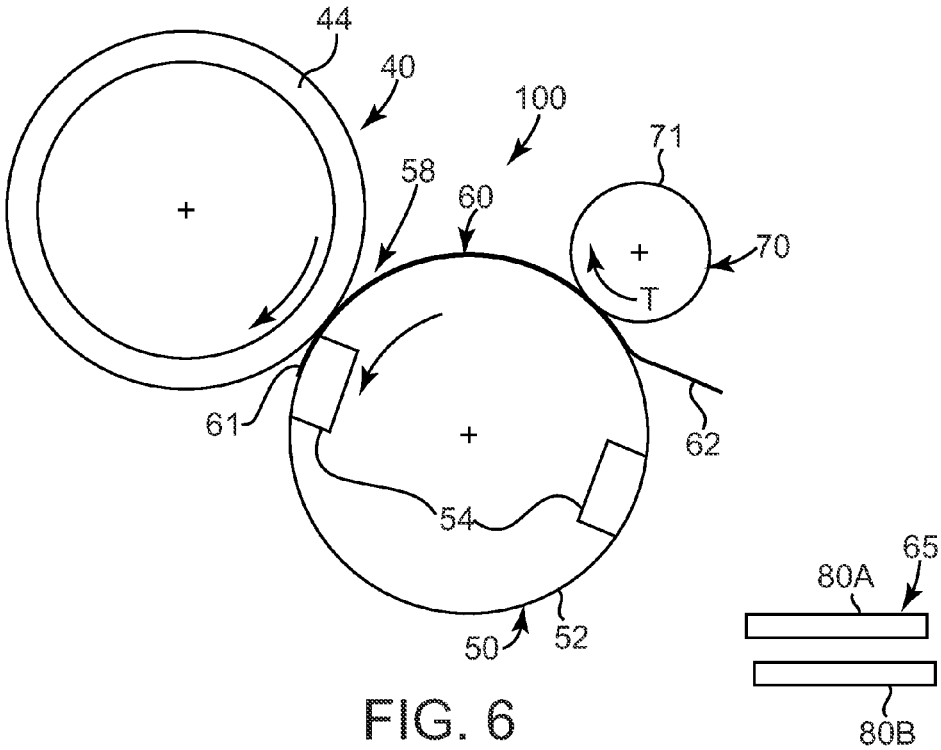

As further shown in FIG. 6, even as media sheet 60 is passing through nip 58 (between blanket cylinder 40 and impression cylinder 50) at which the image is being transferred onto media sheet 60, conditioning roller 70 continues to flatten remaining portions of sheet 60 until pressure has been applied through the second end 62 of sheet 60.

Figure 7:
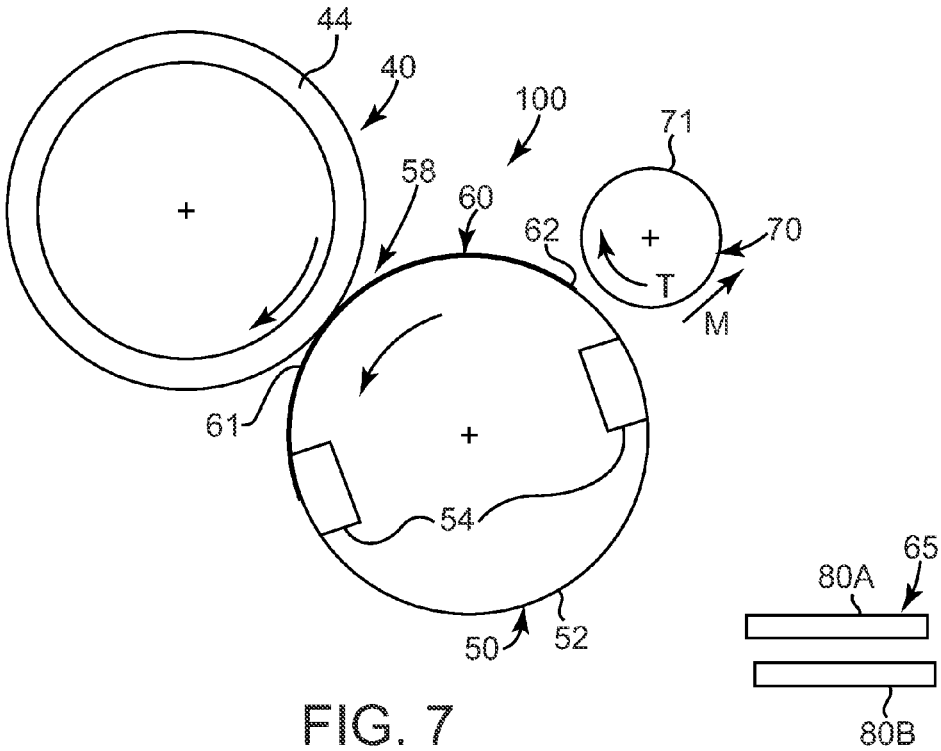

After second end 62 of media sheet 60 has advanced beyond conditioning roller 70 (as shown in FIG. 7), controller 38 acts to move conditioning roller 70 away from impression cylinder 50, as represented by directional arrow M. With conditioning roller 70 dis-engaged from impression cylinder 50, roller assembly 100 provides sufficient clearance or space for passage of gripper 54 underneath conditioning roller 70 as impression cylinder 50 continues rotating to move media sheet 60 through nip 58.

It will be understood that after the image (on blanket cylinder 40) has been completely transferred onto media sheet 60, in some instances, controller 38 of system 15 releases media sheet 60 from gripper 54 and media sheet 60 is further guided through system 15 to a finishing station or media output module. Accordingly, in this example media sheet 60 will make a single pass through nip 58 and conditioning roller 70 acts to condition media sheet 60 before any ink is applied to media sheet 60.

However, in other embodiments, media sheet 60 will make multiple passes through image-transfer nip 58 to receive the image as expressed in different color separations. In these embodiments, regardless of whether a slightly different deformation is introduced into media sheet upon each cycle, conditioning roller 70 acts to flatten media sheet 60 to ensure proper color plane registration.

Figure 8:
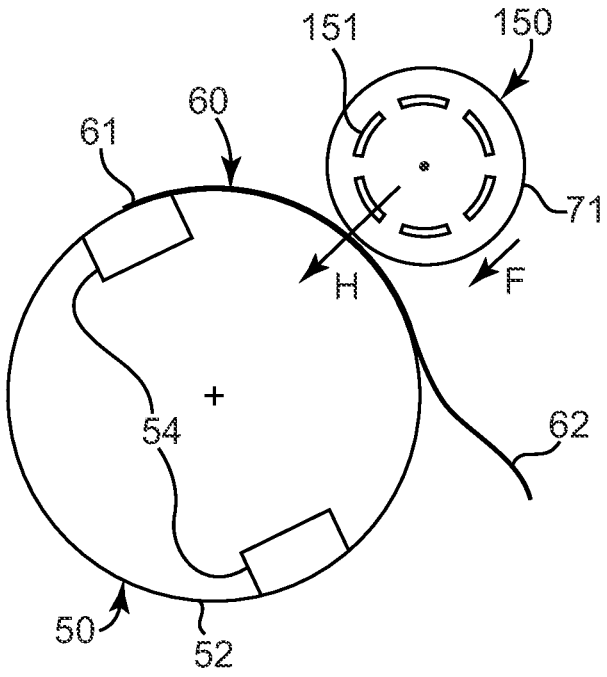
FIG. 8 is a side view schematically illustrating a roller with heating element, according to an embodiment of the present disclosure.

FIG. 8 is a side view of a conditioning roller 150, according to one embodiment of the present disclosure. In one embodiment, conditioning roller 150 includes substantially the same features and attributes as conditioning roller 70 of roller assembly 100, as previously described in association with FIGS. 1-7. Moreover, in addition, conditioning roller 150 comprises one or more heating elements 151 such that heat (represented by directional arrow H) is applied to media sheet 60 simultaneous with the pressure being applied via roller 150 (as represented by directional arrow F in FIGS. 4 and 8). In one aspect, controller 38 provides an operator with the ability to activate and de-activate application of heat (via heating elements 111) via conditioning roller 150.

With this arrangement, both heat and pressure is applied to media sheet 60 prior to nip 58 (between intermediate blanket cylinder 40 and impression cylinder 50) at which an image is transferred onto media sheet 60. The heat, when accompanying the applied pressure, enhances ink adhesion.

Embodiments of the present disclosure ensure proper color plane registration of a blanket cylinder with a media sheet (carried by an impression cylinder) by applying pressure to the media sheet via a conditioning roller positioned prior to the nip between the blanket cylinder and the impression cylinder. In some embodiments, heat is applied via the conditioning roller simultaneous with pressure. This arrangement achieves high quality printing while minimizing additional steps or complex mechanisms sometimes associated with conventional systems for achieving color plane registration.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A digital press comprising:

a blanket cylinder;

an impression cylinder rollingly engaged relative to the blanket cylinder to form a nip, the impression cylinder including at least one gripper to selectively secure an end of a media sheet relative to the impression cylinder; and a roller selectively engageable against the impression cylinder to apply pressure to the secured media sheet prior to passage of the media sheet through the nip, wherein the digital press is a digital color offset press to transfer the image one color at a time through successive cycles of the same media sheet through the nip, and wherein the roller applies pressure to the same media sheet in each cycle.

2. The digital press of claim 1, wherein the roller includes a heating mechanism to apply heat to the media sheet simultaneous with application of pressure.

3. The digital press of claim 1, wherein the roller forms part of a roller assembly including:

a translational module operably coupled to the roller and to cause selective engagement of the roller relative to the impression cylinder; and a pressure module operably coupled to the roller and to selectively cause the roller to apply pressure against the impression cylinder.

4. The digital press of claim 3, the translational module to cause selective disengagement of the roller relative to the impression cylinder in a region of the gripper of the impression cylinder.

5. The digital press of claim 3, comprising:

a controller in communication with the translational module and the pressure module and to cause the roller to rotate at substantially the same velocity as the impression cylinder.

6. The digital press of claim 1, comprising:

a controller to transfer the image one color at a time in successive cycles without including an idle cycle prior to application of the first color.

7. A method of alignment for printing in a digital press, the method comprising:

selectively retaining a first end of a media relative to an impression cylinder;

flattening the retained media sheet, prior to a nip between a blanket cylinder and the impression cylinder, about a contour of the impression cylinder via selective engagement of a roller directly against the impression cylinder; and transferring, via the nip, an image one color at a time to the media sheet, wherein the image includes a plurality of colors, wherein flattening the media sheet, via the selectively engageable roller, includes flattening the media sheet, prior to the nip, each time the same media sheet passes through the nip throughout successive cycles of the same impression cylinder to receive a respective one of the colors from the blanket cylinder to achieve color plane registration for all the respective colors on the same media sheet.

8. The method of claim 7, comprising:

applying heat, simultaneous with the flattening, to the retained media sheet.

9. The method of claim 7, comprising:

disengaging the roller from the impression cylinder after the media sheet has been flattened.

10. The digital press of claim 1, wherein the impression cylinder comprises the sole impression cylinder of the digital press.

11. A media sheet registration assembly comprising:

an impression cylinder to rollingly engage a blanket cylinder to form a nip, the impression cylinder including at least one gripper to selectively secure an end of a media sheet relative to the impression cylinder; and a roller selectively engageable directly against the impression cylinder to apply to pressure on the secured media sheet between the roller and the impression cylinder prior to transfer of an image onto the secured media sheet; and a heating mechanism to apply heat via the roller, simultaneous with the applied pressure, to a secured media sheet, wherein the media sheet registration assembly forms part of a digital color offset press to transfer the image one color at a time through successive cycles of the media sheet through the nip to achieve color plane registration, and wherein the roller applies pressure to the media sheet in each cycle.

12. The media sheet registration assembly of claim 11, wherein the impression cylinder is the sole impression cylinder of the media sheet registration assembly.

13. The method of claim 7, comprising:

maintaining the same media sheet on the same impression cylinder until all of the respective colors are transferred onto the media sheet, wherein one color is transferred for each cycle of the impression cylinder.

* * * * *